United States Patent [19]

Sutehall

[11] 4,106,403

[45] Aug. 15, 1978

[54] BAND FEED GUIDES

[75] Inventor: Donald Sutehall, Harlow, England

[73] Assignee: Gerrard Industries Limited, England

[21] Appl. No.: 782,318

[22] Filed: Mar. 29, 1977

[30] Foreign Application Priority Data

Apr. 3, 1976 [GB] United Kingdom ..... 13618/76

[51] Int. Cl.[2] ..... B65B 13/04

[52] U.S. Cl. ..... 100/25

[58] Field of Search ..... 100/25, 26

[56] References Cited

U.S. PATENT DOCUMENTS

| | | | |
|---|---|---|---|
| 2,977,872 | 4/1961 | Allfree | 100/25 |
| 3,052,178 | 9/1962 | Hall | 100/25 |
| 3,182,586 | 5/1965 | Armington | 100/25 |
| 3,213,781 | 10/1965 | Collins | 100/25 |

*Primary Examiner*—Billy J. Wilhite

*Attorney, Agent, or Firm*—Kemon & Estabrook

[57] ABSTRACT

For use with banding apparatus for putting bands, especially those of plastics banding, around a pallet and its load, a band feed guide for threading banding through the voids between the deck and runners of the pallet. The band feed guide is made up of tapering channel chute sections comprising primary chute sections which telescope with secondary chute sections and are extended axially into the voids when the pallet is at the apparatus to form with the secondary chute sections a continuous band feed guide below the deck of the pallet. In the telescoping condition the chute sections can be swung down below the level of the runners while the pallet is moved.

11 Claims, 4 Drawing Figures

BAND FEED GUIDES

This invention relates to band feed guides for banding that is to be put around loads on pallets.

Overhead band feed units are known in which band is fed from one side of the pallet, over the top and down the other side of the load. With steel and similar stiff banding it is further known to project the banding out of the band track, through a first void between the deck and one side runner of the pallet. On the other side of the void the banding enters the wide mouth of a tapering chute supported under the pallet by the banding apparatus. The narrow end of the tapering chute directs the banding through a second void between an intermediate runner and the deck of the pallet to be captured again in the wide mouth of a second tapering chute the narrow end of which similarly projects the strapping across the final void between the opposite side runner and the deck of the pallet.

Banding made of plastics such as nylon, polypropylene or polyester is not stiff enough to be projected through the voids and captured again in this manner and it is an object of the present invention to provide means of overcoming this difficulty.

The present invention consists in banding apparatus for securing a load on a pallet and having a band free guide for threading banding through the voids between the deck and runners of a pallet and comprising at least two primary chute sections which are mounted for movement into the voids of a pellet at the apparatus to join at least one secondary chute section and form therewith a continuous guide below the deck of the pallet, the secondary chute section or sections being so mounted in the apparatus as to lie between the runners of the pallet.

The primary chute sections are retracted while the pallets are brought to, and removed from, the apparatus and only moved into the voids when the pallet is stationary. The primary chute sections may be moved axially into the voids and one of them may be arranged to telescope, on retraction, with the secondary chute section, or, where there is more than one secondary chute section, chute sections may telescope in pairs each of one primary and one secondary chute sections. The chute sections may taper and be so arranged that when the primary sections are moved the smaller end of the section enters the larger end of the next section in the direction of the band feed. The primary chute section at the side of the pallet at which the band enters the band guide may be so arranged that on movement into the pallet void it registers with the exit end of a band track for feeding band from a band supply, the band track extending, for example, down one side of a loaded pallet.

For use with pallets having just two parallel runners, only one secondary chute section need be provided but for pallets with three or more parallel runners, a further secondary chute section and associated primary chute section is needed for each additional runner.

Provided that the pellets are of suitable construction, the secondary chute section or sections could be fixed so as to project above the top of a support, such as a conveyor, on which the runners of the pallet rest at the apparatus, the runners straddling the secondary chute section or sections. Alternatively the primary and secondary chute sections may be movable between an inoperative position below the top of the support and a raised position in which they project above the top of the support. The chute sections may be mounted for vertical movement between the inoperative and raised positions or on arms for angular movement about a fixed axis.

In a preferred form of the invention the primary and secondary chute sections are mounted on a shaft below the top of the support and parallel to the chute axis. The shaft can be moved angularly to swing the chute sections between the raised and inoperative positions. The primary chute sections are also movable axially of the shaft for movement into and out of the voids of the pallet. On retraction one of the primary chute sections telescopes with the secondary chute section or where there is more than one secondary chute section, an associated primary chute section telescopes with each secondary chute section. Instead of being arranged for angular movement the compound shaft may be mounted for bodily vertical movement to raise and lower the chute.

The accompanying drawings illustrate an embodiment of the above-described preferred form of the invention. In the drawings.

Figure 1:
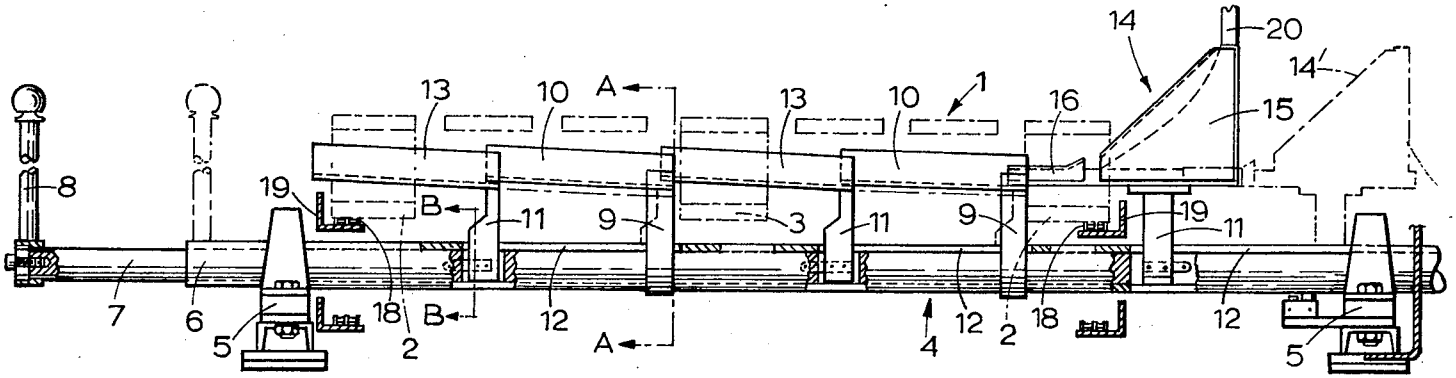
FIG. 1 is an elevation, partly in section, of a band feed guide forming part of banding apparatus according to the invention.

At the binding apparatus only part of which is illustrated in the drawings a pallet 1 having side runners 2 and a central intermediate runner 3 is supported by its side runners 2 only which rest on conveyor chains 18 running on angle section supports 19. Between and parallel to the axis of the rollers of the conveyor chains 18 a compound shaft 4 is mounted in bearings 5. The compound shaft 4 comprises an outer tube 6 and an inner shaft 7. A radial handle 8 is fixed to one end of the shaft 7 which projects from the outer tube 6. By manipulation of the handle 8 the compound shaft 4 can be angularly moved as a unit and the inner shaft 7 can be slid axially with respect to the outer tube 6.

U-shaped straps 9 (FIG. 3) are fitted around and secured to the outer tube 6 at axially spaced positions. The arms of the U-shaped straps 9 extend tangentially of the tube 6 and between the ends of each strap is fitted a secondary chute section 10 of U-shaped cross-section with the open side radially away from the tube 6. Each secondary chute section 10 tapers in width from the wider end which is secured to the strap 9. Arms 11 secured in transverse slots in the shaft 7 extend radially through elongated axial slots 12 in the tube 6. At their outer ends the arms 11 carry primary chute sections 13. The shaft 7 is slidable axially inside the tube 6 within the limits imposed by the engagement of the arms 11 with the ends of the slots 12. At one extreme of this axial movement the primary chute sections 13 telescope with the secondary chute sections 10 as shown in broken lines 13' in FIG. 1 and 2. At the other extreme of the axial movement the primary chute sections 13 occupy the positions shown in full lines in FIGS. 1 and 2 in which the narrower end of one chute section extends into the wider end of the next chute section. The arm 11 at the end of the shaft 7 opposite the handle 8 supports a primary chute section 14 of rather different shape having a curved portion 15 lying in the axial plane of the shaft and leading at its radially inner end to a nozzle 16 aligned with the primary chute sections 13. In the extended position (shown in FIGS. 1 and 2 in full lines) of the primary chute section 14, the radially outer end of the curved portion 15 is aligned with the end of a depending band feed track 20 extending down the side of the loaded pallet.

Figure 2:
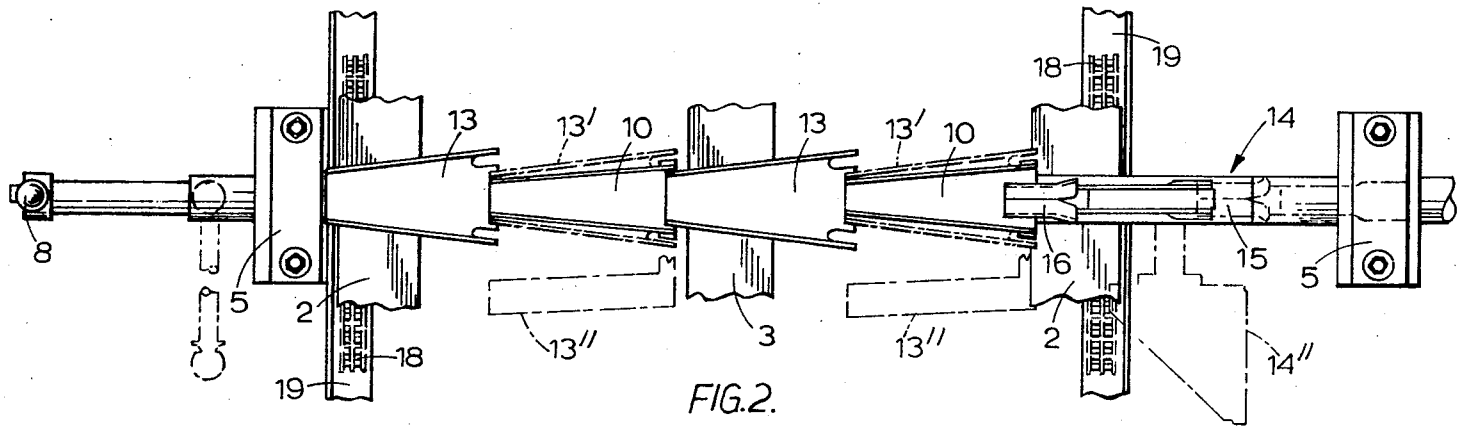
FIG. 2 is a plan view.
Figure 3:
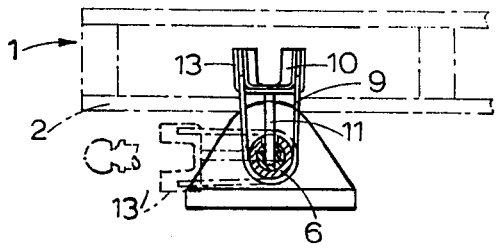
FIG. 3 is a section on line A—A in FIG. 1 but showing chute components telescoped.
Figure 4:
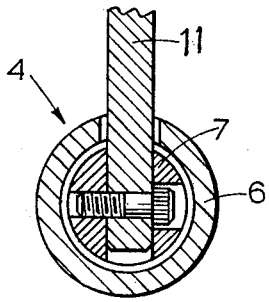
FIG. 4 is a section on line B—B in FIG. 1.

When the primary chute sections 13 and 14 are in the raised positions indicated in broken lines 13', 14' in FIGS. 1 and 2 with the sections 13 telescoping with the secondary chute sections 10 all the chute sections can be swung down to an inoperative position by swinging the handle 8 to turn the shaft 4 through 90°. In the inoperative position the chute sections 10, 13 and 14 all lie below the level of the top of the conveyor as shown in broken lines at 13" and 14" in FIGS. 2 and 3. This is the position they occupy while pallets are being moved along the conveyor. When a pallet has been positioned ready for banding, the operator, who stands on the side of the conveyor near the handle 8, swings the handle 8 upwards to swing the chute sections 10, 13, 14 and 15 upwards and then pulls the handle 8 outwards to move the primary band chute sections 13 and 14 axially to the raised positions shown in full lines in FIGS. 1 and 2 forming a continuous chute above the level of the top of the support but below the deck of the pallet and extending through the voids between the runners 2 and 3 and the pallet deck. Band from the upright band track 20 can then be fed into curved portion 15 and the nozzle 16 of the chute section 14 and along the chute sections 10 and 13 to the operator's position, to be tightened and joined to the supply end of the band by a suitable tensioning and jointing apparatus. Further bands may be applied in other positions around the pallet by moving the pallet. Whether, in order to move the pallet, it is necessary merely to retract the primary chute section 13 to the telescoping position or to swing the chute sections down to the inoperative position will depend on the pallet construction, for example, on what obstructions there are between the runners and in the voids between the runners and the deck of the pallet.

Although the embodiment described involves some manual operations the apparatus may readily be adapted for power operation by hydraulic, electrical or mechanical means or a combination of these. For example, one hydraulic cylinder and piston assembly mounted parallel to the shaft 4 may move the inner shaft 7 axially and another hydraulic cylinder and position assembly may be connected to an arm extending radially from the tube 6 to move it angularly.

We claim:

1. In banding apparatus for securing a load on a pallet and having a band feed guide means for threading banding through the voids between the deck and runners of a pallet and comprising spaced supports with conveyor means positioned thereon for moving said pallet, at least two primary chute sections and at least one secondary chute section, carrier means for mounting the chute sections, the primary chute sections being mounted on the carrier means for movement into the voids of a pallet at the apparatus to join the secondary chute section and form therewith a continuous guide below the deck of the pallet, the secondary chute section being so mounted in the apparatus as to lie between the runners of the pallet.

2. Banding apparatus according to claim 1 wherein the primary sections are movable by the carrier means along the axis of the guide into the voids.

3. Banding apparatus according to claim 2 wherein, on retraction of the primary chute sections from the voids, one of the primary chute sections telescopes with the secondary chute section.

4. Banding apparatus according to claim 2 and having more than one secondary chute section, an associated primary chute section telescoping with each secondary chute section.

5. Banding apparatus according to claim 1 wherein the chute sections taper in the direction of band feed through the guide, the arrangement being such that after movement of the primary sections into the voids the smaller end of one chute section enters the larger end of the next section in the direction of the band feed.

6. Banding apparatus according to claim 1 wherein the primary and secondary sections are movable between an inoperative position below the top of a support for the pallet and a raised position in which the sections project above the top of the support.

7. Banding apparatus according to claim 6 wherein the primary and secondary sections are mounted for angular movement between the inoperative position and the raised position.

8. Banding apparatus as set forth in claim 1 and including a band track and means for feeding band along the band track from a band supply wherein the primary chute section at the side of the pallet at which the band enters the band guide is so arranged that on movement into the pallet void it registers with the exit end of the band track.

9. Banding apparatus according to claim 8 wherein the band track is upright to lead band, which is fed through it downwards from the band supply, into the guide formed by the chute sections.

10. Banding apparatus as set forth in claim 1 wherein said carrier means includes a shaft have said primary and secondary chute sections supported thereon, said shaft having means for rotating same to swing the chute sections between an inoperative position below the top of the supports and a raised position in which the chute sections project above the top of the supports, the primary chute sections being also movable axially of the shaft for movement into and out of the voids of the pallet and on retraction from the voids an associated primary chute section telescoping with each secondary chute section.

11. Banding apparatus according to claim 10 wherein the shaft is a compound shaft comprising an inner shaft axially slidable in a surrounding tube, the secondary chute section or sections being supported by brackets mounted on the tube and the primary chute sections on arms mounted on the inner shaft and extending through axial slots in the tube.

* * * * *